US010707586B2

(12) United States Patent
Shimada

(10) Patent No.: US 10,707,586 B2
(45) Date of Patent: Jul. 7, 2020

(54) WIRE WITH TERMINAL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Takanobu Shimada, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/231,641

(22) Filed: Dec. 24, 2018

(65) Prior Publication Data

US 2019/0199007 A1 Jun. 27, 2019

(30) Foreign Application Priority Data

Dec. 26, 2017 (JP) ..... 2017-249521

(51) Int. Cl.

| | |
|---|---|
| ***H01R 13/02*** | (2006.01) |
| ***H01R 4/18*** | (2006.01) |
| *H01R 4/62* | (2006.01) |
| *H01R 43/048* | (2006.01) |

(52) U.S. Cl.

CPC ..... *H01R 4/185* (2013.01); *H01R 4/184* (2013.01); *H01R 4/188* (2013.01); *H01R 13/02* (2013.01); *H01R 4/62* (2013.01); *H01R 43/048* (2013.01)

(58) Field of Classification Search

CPC ..... H01R 4/185; H01R 4/188; H01R 13/02; H01R 43/048; H01R 4/62; H01R 4/184

See application file for complete search history.

(56) References Cited

U.S. PATENT DOCUMENTS

| | | | | |
|---|---|---|---|---|
| 5,567,187 | A * | 10/1996 | Bellinger | H01R 4/185 439/866 |
| 9,263,165 | B2 * | 2/2016 | Yoshinaga | C22C 9/00 |
| 2010/0261391 | A1 | 10/2010 | Ono et al. | |
| 2013/0130570 | A1 * | 5/2013 | Onuma | H01R 4/188 439/882 |
| 2015/0079825 | A1 * | 3/2015 | Miyamoto | H01R 4/206 439/152 |

(Continued)

FOREIGN PATENT DOCUMENTS

| | | |
|---|---|---|
| JP | 2009-117039 | 5/2009 |

*Primary Examiner* — Truc T Nguyen

(74) *Attorney, Agent, or Firm* — Gerald E. Hespos; Michael J. Porco; Matthew T. Hespos

(57) ABSTRACT

A terminal (20) is connected to a core (12) of a wire (13). The terminal (20) includes two wire barrels (25L, 25R) extending from a bottom portion (22) on which the core (12) is placed. The wire barrels (25L, 25R) are crimped to wind around the core (12). The core (12) includes strands (11) made of metal having a larger tensile strength than metal of the female terminal (20). At least first, second and third strands (11J, 11K) and (11L) are disposed side by side in a direction intersecting an extending direction of the core (20) inside the wire barrels (25L, 25R). A tip of the wire barrels (25L, 25R) is inserted between the first and second strands (11J, 11K) and a tip of the other of the pair of wire barrels (25L, 25R) is inserted between the second and third strands (11K, 11L).

9 Claims, 7 Drawing Sheets

(56) References Cited

U.S. PATENT DOCUMENTS

| | | | | |
|---|---|---|---|---|
| 2016/0012943 | A1* | 1/2016 | Rachi | H01B 7/2806<br>174/72 A |
| 2018/0375276 | A1* | 12/2018 | Onuma | H01R 43/005 |

* cited by examiner

WIRE WITH TERMINAL

BACKGROUND

Field of the Invention

This specification relates to a wire with terminal in which a terminal fitting is connected to an end part of a wire.

Related Art

Japanese Unexamined Patent Publication No. 2009-117039 discloses a wire with terminal in which a terminal is connected to a core of a wire. The core includes strands made of conductive metal. The terminal includes a bottom portion on which the core is placed, and two wire barrels extend from this bottom portion. The wire barrels are crimped to wind around the outer periphery of the core. In this way, the wire and the terminal are connected electrically.

Recently, wires have been required to be thinner, and a core may not have sufficient strength against an external force applied to a thin wire. The strength of strands of the core could be improved to suppress a trouble of the core due to an external force. However, the strength of a metal of the strands could become larger than that of a metal material of the terminal. In such a case, tips of the crimped wire barrels may not be pushed into the strands of the core. Then, if a force acts on the wire barrels in a direction to expand and deform the wire barrels, the tips of the wire barrels may be separated from the core and electrical connection reliability between the wire and the terminal may be reduced.

This invention was completed in view the above situation and aims to provide a wire with terminal having improved electrical connection reliability.

SUMMARY

The invention is directed to a wire with terminal in which a terminal is connected to a core of a wire including the core. The terminal includes two wire barrels extending from a bottom on which the core is to be placed, and the wire barrels are crimped to wind around an outer periphery of the core. The core includes strands made of metal having a larger tensile strength than that of metal of the terminal and, with the wire barrels crimped to the core, at least first, second and third strands are disposed side by side in a direction intersecting an extending direction of the core inside the wire barrels. A tip of one of the wire barrels is inserted between the first and second strands and a tip of the other of the wire barrels is inserted between the second and third strands.

The tips of the wire barrels are sandwiched by the first, second and third strands according to the above configuration. Thus, the opening of the wire barrels can be suppressed, and electrical connection reliability between the wire and the terminal can be improved.

A fitting dimension of the tips of the wire barrels between the first and second strands and between the second and third strands may equal or exceed a radius Rw of each of the strands in a state before the wire barrels are crimped to the core. According to this configuration, the tips of the wire barrels are inserted between adjacent ones of the first, second and third strands by a dimension at least equal to or larger than the radius Rw of the strands. Since the tips of the wire barrels are sandwiched reliably by the first, second and third strands in this way, electrical connection reliability between the wire and the terminal can be improved.

If the core is relatively thin, a tensile strength of the strands of the core is required to be relatively large to suppress the breakage of the core. The invention is effective when the core is thin, such as when there no more than seven strands.

Parts of the wire barrels exposed from between the first and second strands and between the second and third strands may be formed with contact portions to be brought into contact with each other. Accordingly, the wire barrels contact each other on the contact portions to suppress the opening of the wire barrels. Thus, electrical connection reliability between the wire and the terminal can be improved.

In one embodiment, a radius of curvature Rb of an outer surface of each of the wire barrels crimped to the core satisfies a relationship defined by the following Equation (1) with a thickness T of the wire barrels and the radius Rw of the strands in the state before the wire barrels are crimped to the core:

$$Rb>T+Rw \quad (1).$$

Thus, a space capable of accommodating at least one strand can be provided in an area inside bent parts of the pair of wire barrels. In this way, the tips of the wire barrels can be inserted more deeply inserted into the core.

The plurality of strands may be seven strands, and a width W of the bottom portion in the intersecting direction with the wire barrels crimped to the core preferably satisfies a relationship defined by the following Equation (2) with a diameter Dw of the strands in the state before the wire barrels are crimped to the core:

$$W>4+Dw \quad (2).$$

According to this configuration, a space in which at least four strands are disposed side by side in the intersecting direction can be secured inside the bottom portion. In this way, the first, second and third strands can be arranged reliably to overlap on the four strands disposed side by side on the bottom portion at a position inside the two wire barrels. In this way, the tips can be inserted between adjacent ones of the first, second and third strands.

According to one embodiment, a central part of the bottom portion in the intersecting direction may bulge out with the two wire barrels crimped to the core, and a height Hb between a central part in the intersecting direction and end parts in the intersecting direction on an inner surface of the bottom portion satisfies a relationship defined by the following Equation (3) with the radius Rw of the strands in the state before the pair of wire barrels are crimped to the core:

$$Hb>Rw \quad (3).$$

Accordingly, the strand at a central position in the intersecting direction is disposed at a position shifted out at least by the radius of the strand from the strands disposed on the both end parts in the intersecting direction inside the bottom portion. In this way, the second strand can be disposed at the position shifted out at least by the radius of the strand. Thus, the tips of the wire barrels can be inserted more deeply inserted into the core.

According to the invention, it is possible to improve electrical connection reliability between a wire and a terminal.

DETAILED DESCRIPTION

Figure 1:
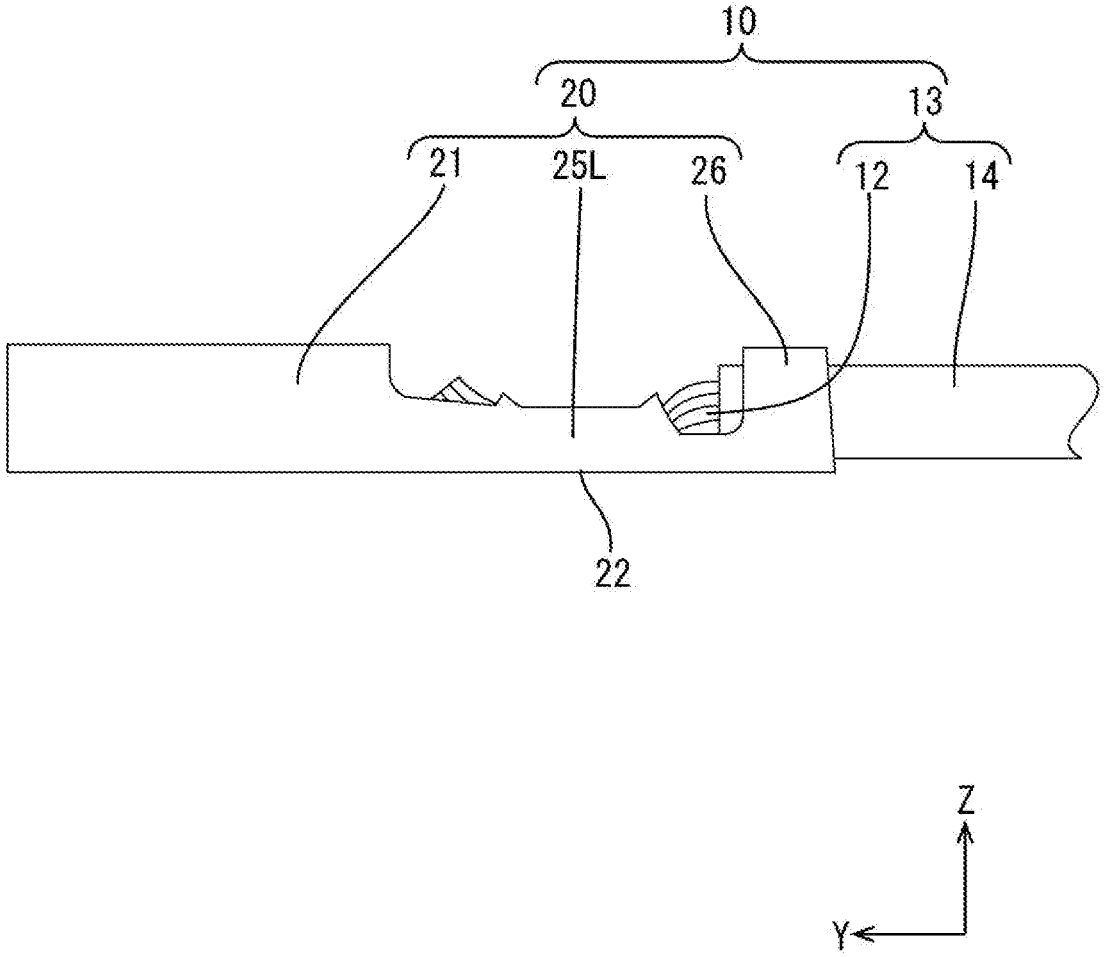
FIG. 1 is a side view showing a wire with terminal according to one embodiment.

An embodiment of the invention is described with reference to FIGS. 1 to 7. In this embodiment, a wire with terminal 10 in which a female terminal 20 is connected to an end of a wire 13 is illustrated as shown in FIG. 1. In the following description, a Z direction, a Y direction and an X direction are respectively referred to as an upward direction, a forward direction and a leftward direction. Further, for a plurality of identical members, one member may be denoted by a reference sign and the other member(s) may not be denoted by the reference sign.

(Wire 13)

Figure 5:
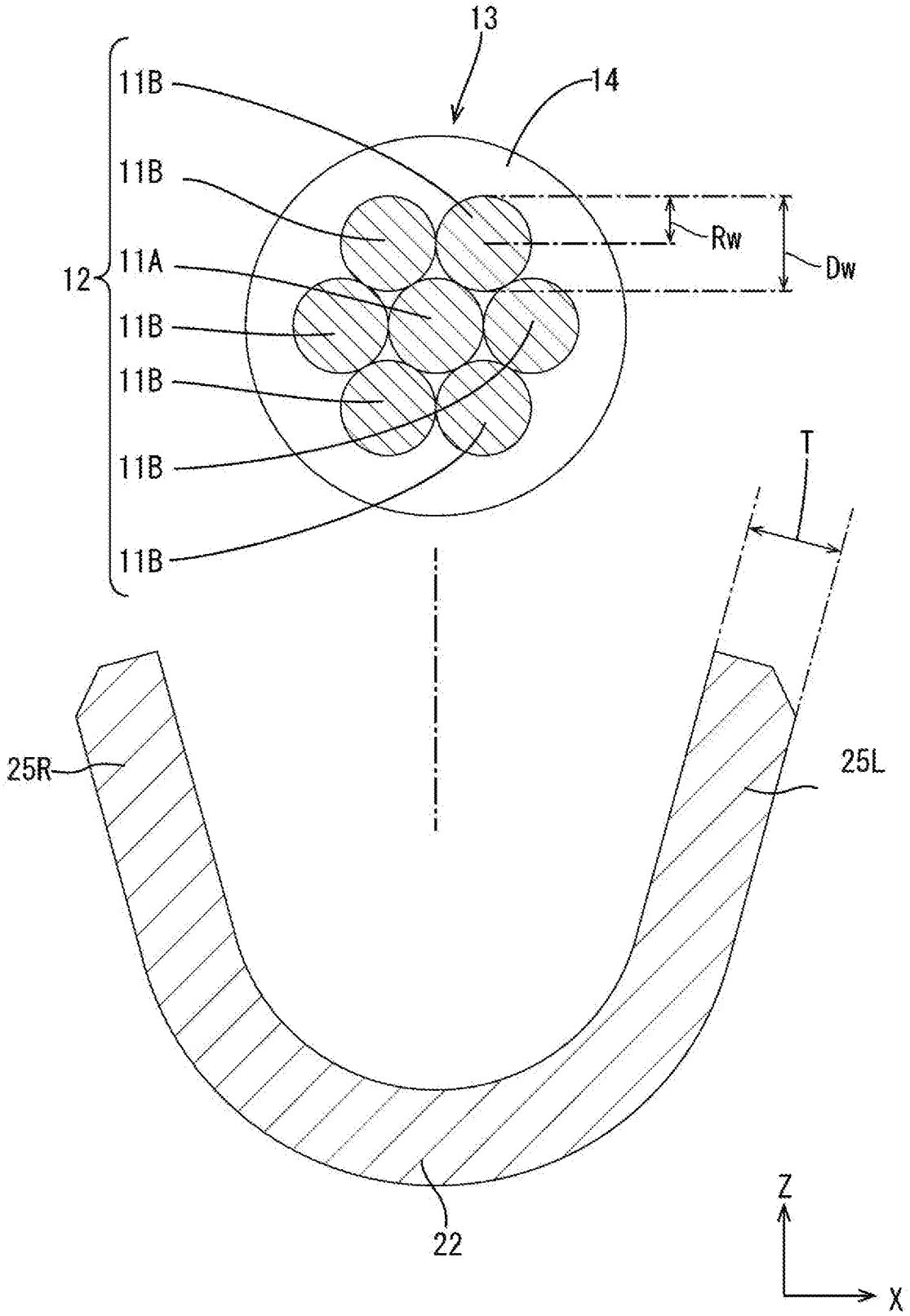
FIG. 5 is a section showing a wire and the wire barrels.

As shown in FIG. 5, the wire 13 is structured such that the outer periphery of a core 12 is covered by an insulation coating 14 made of synthetic resin. The core 12 includes strands 11 (seven in this embodiment) made of conductive metal. The core 12 is a twisted wire formed by twisting the plurality of strands 11. In the core 12, six peripheral strands 11B are twisted spirally with one center strand 11A as a center axis. A cross-sectional area of the core 12 according to this embodiment is 0.05 $mm^2$, but the cross-sectional area of the core 12 is not limited to the above value.

A metal such as copper, copper alloy, aluminum or aluminum alloy can be appropriately selected as the metal constituting the strands 11 if necessary. In this embodiment, copper or copper alloy is used as the metal constituting the strands 11.

The strands 11 have a circular cross-sectional shape in a state before wire barrels 25L, 25R to be described later are crimped. Note that the cross-sectional shape of the strands 11 may be a perfect circular shape or may be such a shape recognized as a substantially circular shape even if it is not a perfect circular shape. A radius of each strand 11 is expressed by Rw and a diameter of each strand 11 is expressed by Dw.

(Female Terminal 20)

As shown in FIG. 1, the female terminal 20 is formed by press-working a metal plate excellent in conductivity and structured such that the wire barrels 25L, 25R and insulation barrels 26 are provided behind a connecting tube portion 21 substantially in the form of a rectangular tube to be electrically connected to a mating male terminal (not shown).

A metal such as copper, copper alloy, aluminum or aluminum alloy can be appropriately selected as the metal constituting the female terminal 20 if necessary. In this embodiment, copper or copper alloy is used.

An unillustrated resilient contact piece is provided inside the connecting tube portion 21. A tab of the male terminal is inserted into the connecting tube portion 21 to resiliently contact the resilient contact piece, whereby the male terminal and the female terminal 20 are electrically connected.

As shown in FIG. 5, the wire barrels 25L, 25R are in the form of an open barrel, and left and right wide wire barrels 25L, 25R are connected to a bottom portion 22 to rise from left and right side edges of the bottom portion 22 while facing each other. A thickness of the wire barrels 25L, 25R before being crimped to the core 12 is expressed by T.

Figure 2:
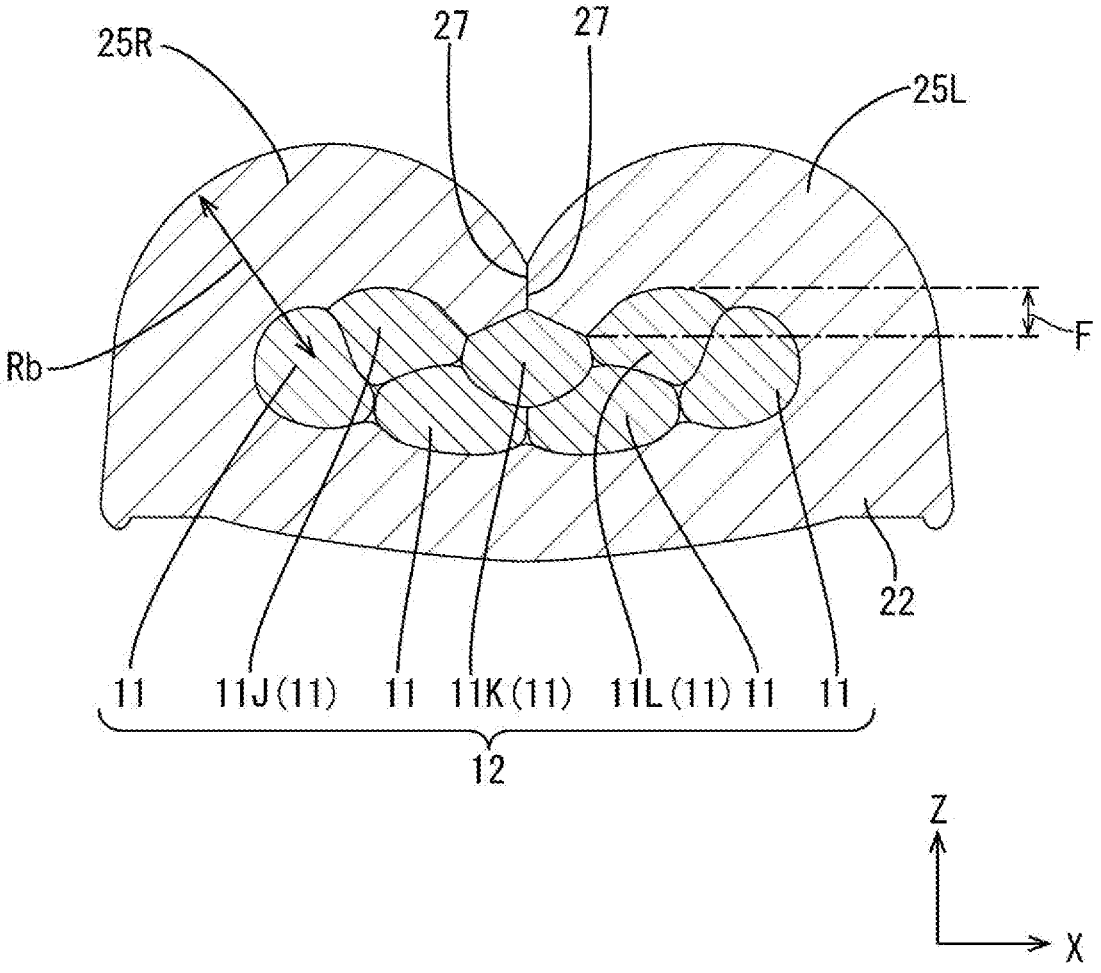
FIG. 2 is a section showing a crimping structure for a core in wire barrels.

The wire barrels 25L, 25R are caulked and crimped to an end of the core 12 of the wire 13 by being vertically crimped. The core 12 extends in a front-rear direction in a state placed on the bottom portion 22. As shown in FIG. 2, the wire barrels 25L, 25R are crimped to the core 12 while being formed into a flat shape that wraps around the end of the core 12 over the entire circumference with tips thereof butted against each other. In this way, the wire 13 and the female terminal 20 are connected electrically.

A width of the bottom portion 22 in a lateral direction with the wire barrels 25L, 25R crimped to the core 12 is expressed by W.

The insulation barrels 26 are in the form of an open barrel. A pair of left and right insulation barrels 26 wider and taller than the wire barrels 25L, 25R are so connected to the bottom portion 22 as to rise from the left and right side edges of the bottom portion 22 while facing each other. The respective insulation barrels 26 are caulked and crimped to an end of the insulation coating 14 of the wire 13 by being vertically crimped. The insulation barrels 26 are caulked to embrace the outer periphery of the end of the insulation coating 14 from both left and right sides.

A tensile strength (JIS Z2241) of the metal material of the strands 11 is larger than a tensile strength (JIS Z2241) of the metal material constituting the female terminal 20. A metal material having a tensile strength of 400 MPa to 1000 MPa can be used as the metal material constituting the strands 11, but the value of the tensile strength is not limited to the above range. A metal material having a tensile strength of 200 MPa to 400 MPa can be used as the metal material constituting the female terminal 20, but the value of the tensile strength is not limited to the above range.

(Crimping Structure)

As shown in FIG. 2, with the wire barrels 25L, 25R crimped to the outer periphery of the core 12, the cross-sectional shape of each strand 11 is distorted from the circular shape due to pressures applied from the wire barrels 25L, 25R.

With the wire barrels 25L, 25R crimped to the outer periphery of the core 12, three strands 11 are disposed side by side in an intersecting direction (lateral direction) intersecting an extending direction of the core 12 at a position below the tip parts of the wire barrels 25L, 25R. These three strands 11 are successively a first strand 11J, a second strand 11K and a third strand 11L from right. The center strand 11A may or may not be included among the first to third strands 11J, 11K and 11L.

Four strands 11 are located side by side in the intersecting direction (lateral direction) intersecting the extending direction of the core 12 below the three strands 11J, 11K and 11L. These four strands 11 are placed on the inner surface of the bottom portion 22. In this way, the four strands 11 and the inner surface of the bottom portion 22 are electrically connected.

The inner surfaces of the wire barrels 25L, 25R are in contact with two strands 11 located on both left and right sides, out of the four strands 11 placed on the inner surface of the bottom portion 22, the first strand 11J and the third strand 11L. In this way, the wire barrels 25L, 25R, the four strands 11, the first strand 11J and the third strand 11L are electrically connected.

The tip part of the right wire barrel 25R, out of the pair of wire barrels 25L, 25R, is inserted between the first and second strands 11J, 11K. Further, the tip part of the left wire barrel 25R is inserted between the second and third strands 11K, 11L. In this way, the wire barrels 25L, 25R are electrically connected to the second strand 11K.

A fitting dimension F of the tip parts of the wire barrels 25L, 25R between the first and second strands 11J, 11K and between the second and third strands 11K, 11L is equal to or larger than the radius Rw of the strands 11 in the state before the wire barrels 25L, 25R are crimped to the core 12.

Parts of the pair of wire barrels 25L, 25R exposed between the first and second strands 11J, 11K and between the second and third strands 11K, 11L are formed with contact portions 27 to be brought into contact with each other at a position above the second strand 11K. The respective contact portions 27 are tightly in surface contact with each other in a state strongly pressed from left and right sides.

As shown in FIG. 2, a radius of curvature of the outer surfaces of the wire barrels 25L, 25R crimped to the core 12 is expressed by Rb. In this embodiment, the radius of curvature Rb of each of the pair of wire barrels 25L, 25R crimped to the core 12 satisfies a relationship defined by the following Equation (1) with the thickness T of the wire barrels 25L, 25R and the radius Rw of the strands 11 in the state before the pair of wire barrels 25L, 25R are crimped to the core 12.

$$Rb>T+Rw \quad (1)$$

Figure 3:
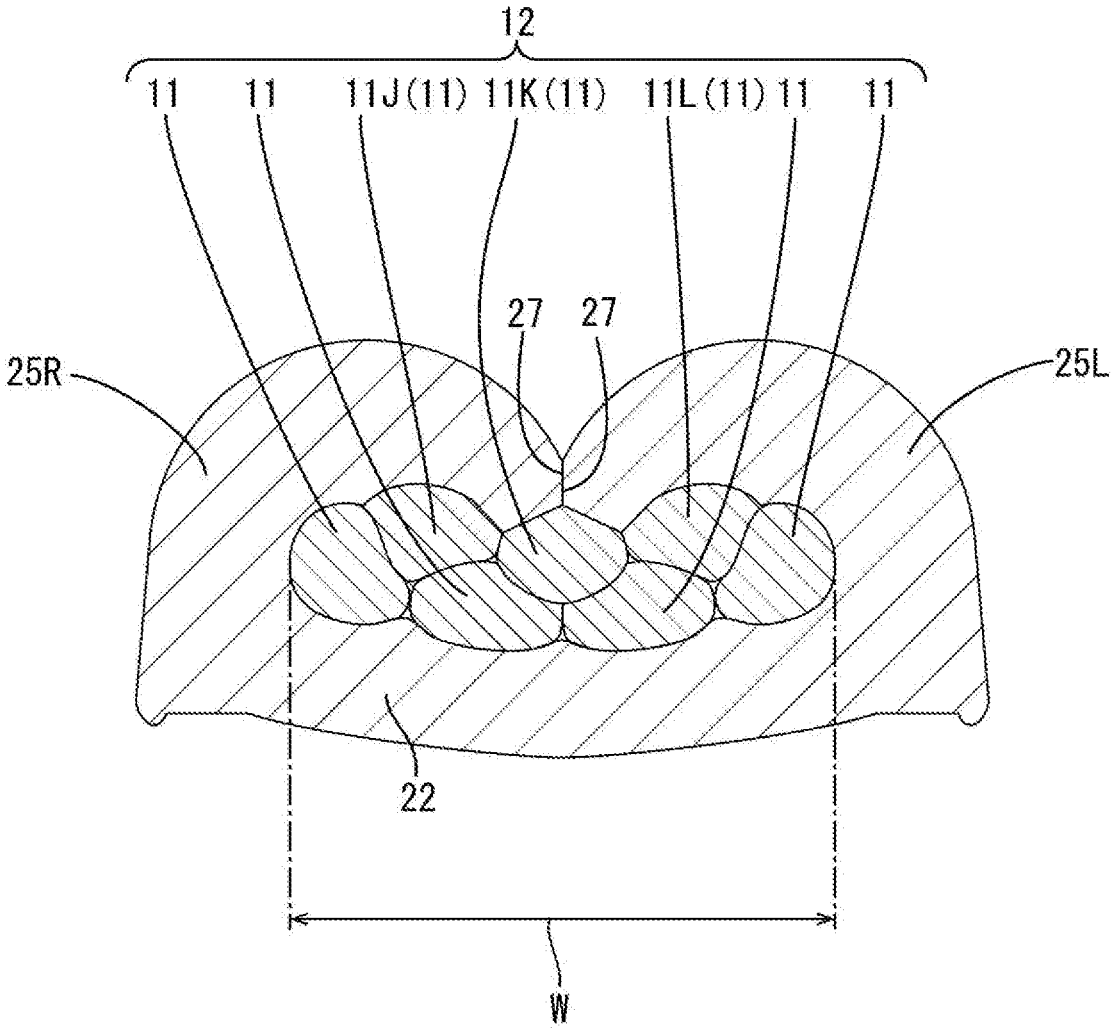
FIG. 3 is a section showing the crimping structure for the core in the wire barrels.

As shown in FIG. 3, a width W of the bottom portion 22 in the lateral direction with the pair of wire barrels 25L, 25R crimped to the core 12 satisfies a relationship defined by the following Equation (2) with the diameter Dw of the strands 11 in the state before the pair of wire barrels 25L, 25R are crimped to the core 12.

$$W>4\times Dw \quad (2)$$

Figure 4:
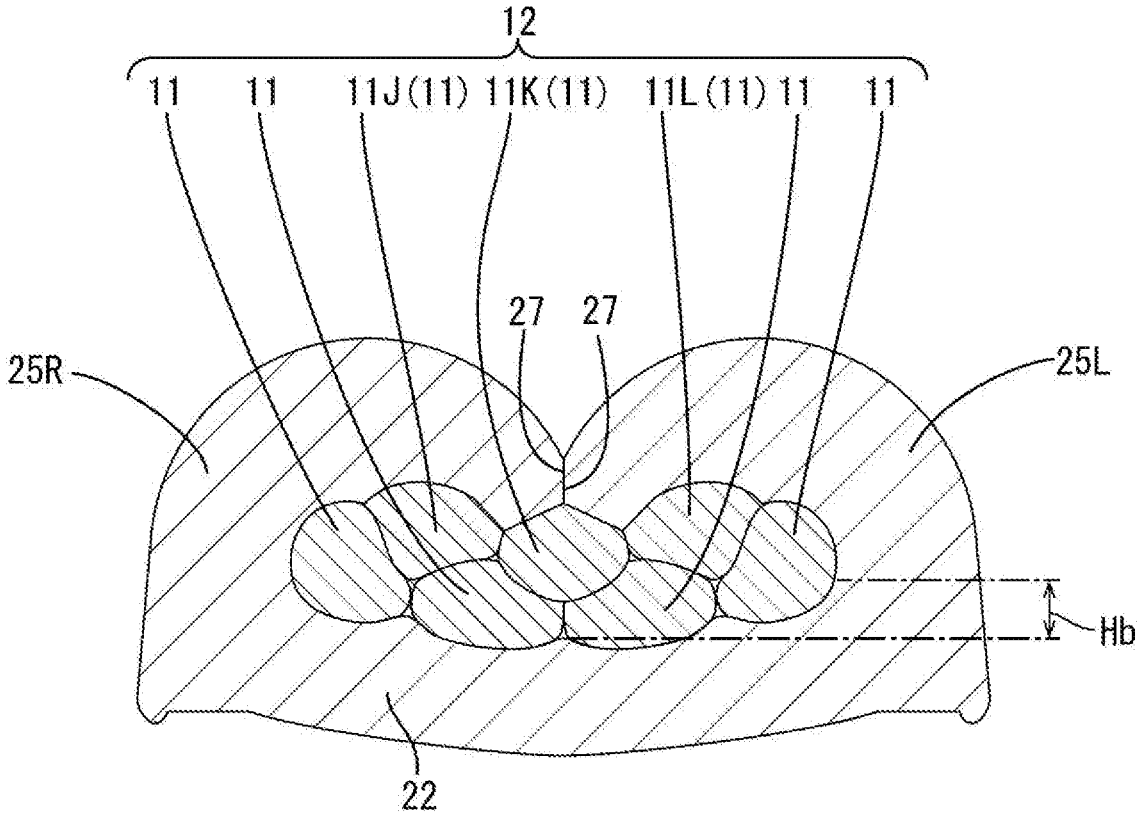
FIG. 4 is a section showing the crimping structure for the core in the wire barrels.

As shown in FIG. 4, with the wire barrels 25L, 25R crimped to the core 12, a central part of the bottom portion 22 in the lateral direction bulges out. A height between a laterally central part and both lateral end parts on the inner surface of the bottom portion 22 is expressed by Hb. This height Hb satisfies a relationship defined by the following Equation (3) with the radius Rw of the strands 11 in the state before the pair of wire barrels 25L, 25R are crimped to the core 12.

$$Hb>Rw \quad (3)$$

Figure 6:
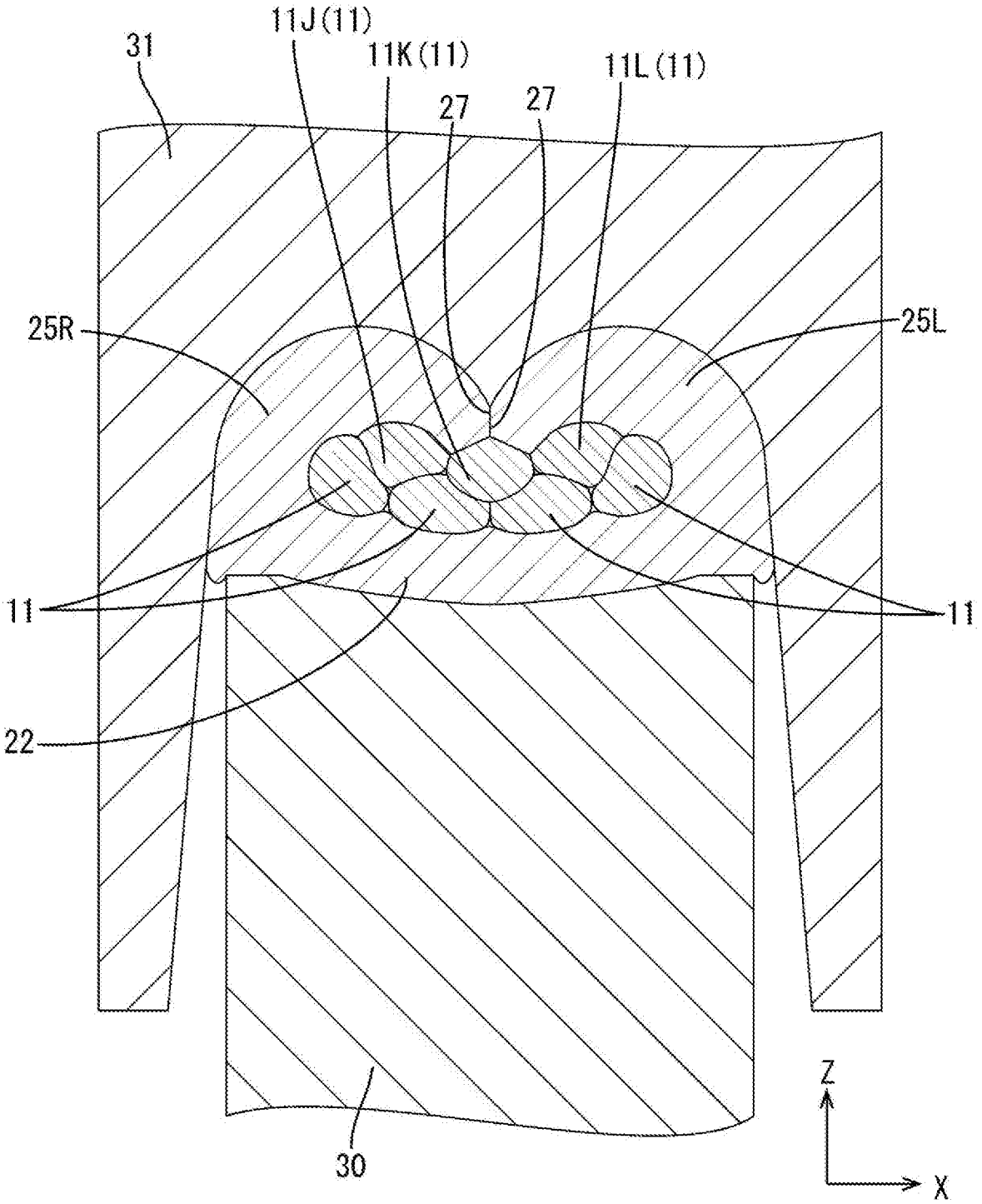
FIG. 6 is a section showing a wire barrel crimping process by an anvil and a crimper.

FIG. 6 shows a process of crimping the wire barrels 25L, 25R of the female terminal 20 to the core 12 by a crimper 31 and the anvil 30. The female terminal 20 is placed on the upper surface of the anvil 30 and the wire 13 is placed on the upper surface of the bottom portion 22. Thereafter, the crimper 31 is brought closer to the anvil 30 from above to crimp the wire barrels 25L, 25R to the wire 13.

The bottom portion 22 of the female terminal 20 is placed on the upper surface of the anvil 30. The upper surface of the anvil 30 is formed such that a laterally central part is recessed downward. The shape of the upper surface of the anvil 30 is transferred to the outer surface of the bottom portion 22 of the wire barrels 25L, 25R. In this way, a height between a laterally central part and both lateral end parts on the upper surface of the anvil 30 coincides with the height Hb described above.

Curved surfaces with which the tip parts of the wire barrels 25L, 25R slide in contact are formed on the lower surface of the crimper 31. The shape of the lower surface of the crimper 31 is transferred to the outer surfaces of the wire barrels 25L, 25R. In this way, a radius of curvature of the curved surfaces formed on the lower surface of the crimper 31 coincides with the radius of curvature Rb described above.

(Functions and Effects of Embodiment)

The wire with terminal 10 according to this embodiment has the female terminal 20 connected to the core 12 of the wire 13. The female terminal 20 includes the two wire barrels 25L, 25R extending from the bottom portion 22 on which the core 12 is to be placed, and the wire barrels 25L, 25R are crimped to wind around the outer periphery of the core 12. The core 12 includes the strands 11 made of metal having a larger tensile strength than that of the metal constituting the female terminal 20. With the wire barrels 25L, 25R crimped to the core 12, at least the first, second and third strands 11J, 11K and 11L are disposed side by side in the lateral direction intersecting the extending direction of the core 12 inside the wire barrels 25L, 25R. The tip part of the wire barrel 25R is inserted between the first and second strands 11J, 11K and the tip of the other wire barrel 25L is inserted between the second and third strands 11K, 11L.

Figure 7:
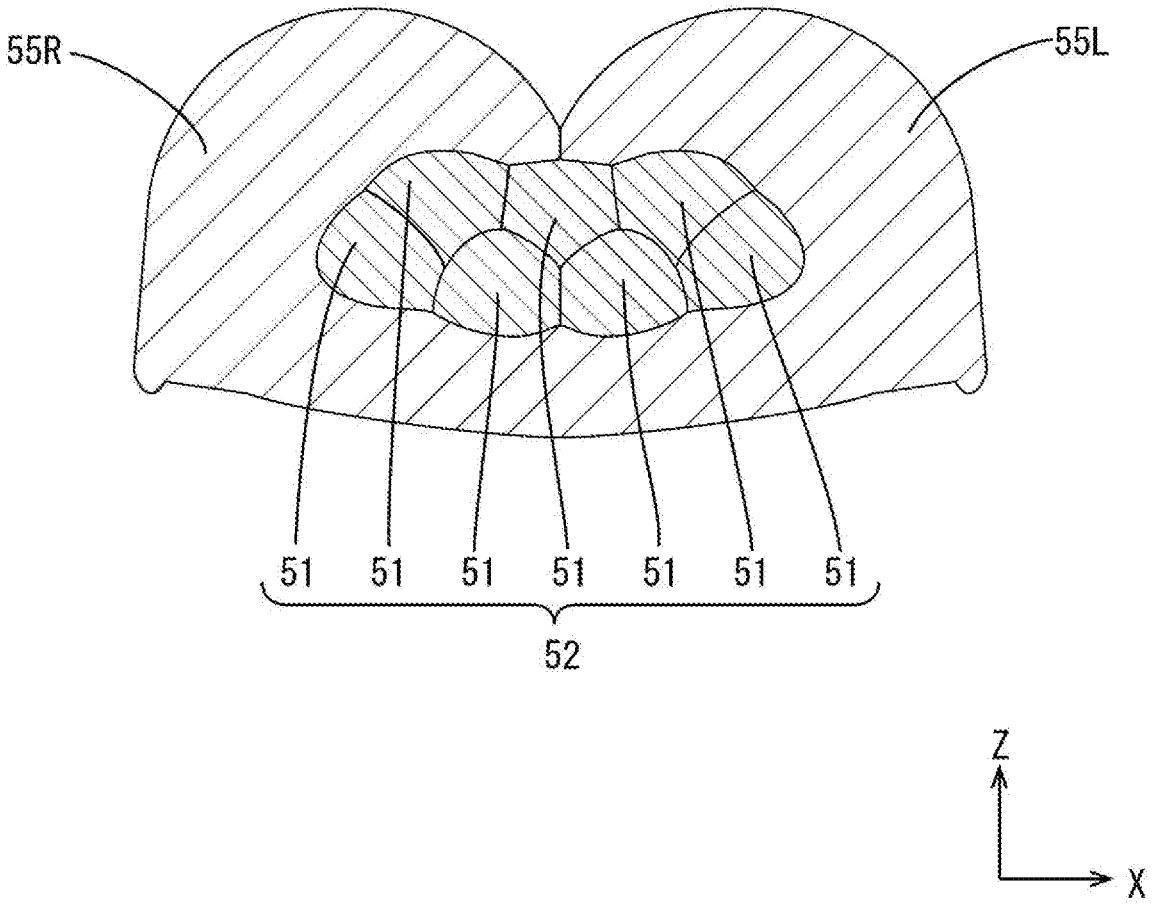
FIG. 7 is a section showing a crimping structure for a core in wire barrels according to a comparative example.

FIG. 7 is a comparative example to describe the functions and effects of this embodiment and shows tip parts of wire barrels 55L, 55R not inserted between adjacent strands 51 of a core 52. In such a case, the tip parts of the wire barrels 55L, 55R are not sandwiched by the strands 51. Thus, a force due to a temperature change causes the wire barrels 55L, 55R to expand and deform. Then, clearances are formed between the wire barrels 55L, 55R and the core 52, so that electrical connection reliability between a terminal and a wire is reduced.

In contrast, the tip parts of the wire barrels 25L, 25R are sandwiched by the first, second and third strands 11J, 11K and 11L according to this embodiment. Thus, the opening of the wire barrels 25L, 25R can be suppressed. In this way, electrical connection reliability between the wire 13 and the female terminal 20 can be improved.

The fitting dimension F of the tip parts of the wire barrels 25L, 25R between the first and second strands 11J, 11K and between the second and third strands 11K, 11L is equal to or larger than the radius Rw of each of the strands 11 in the state before the wire barrels 25L, 25R are crimped to the core 12. Accordingly, tip parts of the wire barrels 25L, 25R are inserted between the first and second strands 11J, 11K and between the second and third strands 11K, 11L by a dimension at least equal to or larger than the radius Rw of the strands 11. The tip parts of the wire barrels 25L, 25R are sandwiched by the first, second and third strands 11J, 11K and 11L in this way. Thus, electrical connection reliability between the wire 13 and the female terminal 20 can be improved.

Further, if the core 12 is relatively thin, the tensile strength of the strands 11 constituting the core 12 is required to be relatively large to suppress the breakage of the core 12. The technique disclosed in this specification can be applied when the core 12 is relatively thin, as just described, such as when the strands 11 are seven or less.

The contact portions 27 to be brought into contact with each other are formed on the parts of the pair of wire barrels 25L, 25R exposed from between the first and second strands 11J, 11K and between the second and third strands 11K, 11L. Accordingly, the wire barrels 25L, 25R contact each other on the contact portions 27 to suppress opening of the wire barrels 25L, 25R. In this way, electrical connection reliability between the wire 13 and the female terminal 20 can be improved.

The radius of curvature Rb of the outer surface of each of the wire barrels 25L, 25R crimped to the core 12 satisfies the relationship defined by the following Equation (1) with the thickness T of the wire barrels 25L, 25R and the radius Rw of the strands 11 in the state before the wire barrels 25L, 25R are crimped to the core 12.

$$Rb>T+Rw \quad (1)$$

According to this configuration, a space capable of accommodating at least one strand 11 can be provided in an area inside bent parts of the wire barrels 25L, 25R. In this way, the tips of the wire barrels 25L, 25R can be inserted more deeply into the core 12.

The core 12 has seven strands 11 and the width W of the bottom portion 22 in the intersecting direction with the wire barrels 25L, 25R crimped to the core 12 satisfies the relationship defined by the following Equation (2) with the diameter Dw of the strands 11 in the state before the wire barrels 25L, 25R are crimped to the core 12.

$$W>4\times Dw \quad (2)$$

According to this configuration, a space in which at least four strands 11 are disposed side by side in the intersecting direction can be secured inside the bottom portion 22. In this way, the first, second and third strands 11J, 11K and 11L can be arranged reliably to overlap on the four strands 11 disposed side by side on the bottom portion 22 at the position inside the two wire barrels 25L, 25R. In this way, the tip parts can be inserted between adjacent ones of the first, second and third strands 11J, 11K and 11L.

With the wire barrels 25 crimped to the core 12, the central part of the bottom portion 22 in the intersecting direction bulges out and the height Hb between the laterally central part and the lateral end parts on the inner surface of the bottom portion 22 satisfies the relationship defined by the following Equation (3) with the radius Rw of the strands 11 in the state before the wire barrels 25L, 25R are crimped to the core 12.

$$Hb>Rw \quad (3)$$

According to this configuration, the strand 11 disposed at a laterally central position inside the bottom portion 22 is disposed at a position shifted outward at least by the radius of the strand 11 from the strands 11 disposed on the lateral end parts. In this way, the second strand 11K can be disposed at the position shifted out at least by the radius of the strand 11. In this way, the tip parts of the wire barrels 25L, 25R can be inserted more deeply into the core 12.

Other Embodiments

The invention is not limited to the above described and illustrated embodiment. For example, the following embodiments also are included in the scope of the invention.

Although the female terminal 20 is illustrated as the terminal in the above embodiment, there is no limitation to this and the terminal may be a male terminal or a round terminal and can have an arbitrary shape. Further, the terminal may not be connected to the end part of the wire 13 and may be a splice terminal for connecting a plurality of wires 13.

Either one or both of a recess and a projection may be formed on a surface of each wire barrel 25L, 25R to be brought into contact with the core 12.

Although the core 12 includes seven strands 11 in the above embodiment, there is not limitation to this and the number of the strands 11 constituting the core 12 is not limited to seven. Further, the plurality of strands may not be twisted.

Although the wire 13 is configured such that the outer periphery of the core 12 is covered by the insulation coating 14 in the above embodiment, there is no limitation to this and the wire 13 may be a so-called bare wire.

LIST OF REFERENCE SIGNS

10: wire with terminal
11: strand
11J: first strand
11K: second strand
11L: third strand
12: core
13: wire
20: female terminal
22: bottom portion
25L, 25R: wire barrel
27: contact portion

What is claimed is:

1. A wire with terminal in which a terminal is connected to a core of a wire, wherein:

the terminal includes first and second wire barrels extending from a bottom portion on which the core is placed, the first wire barrel having opposite inner and outer surfaces and a first tip adjacent the inner surface and the second wire barrel having opposite inner and outer surfaces and a second tip adjacent the inner surface, the first and second wire barrels being crimped to wind around an outer periphery of the core;

the core includes strands made of metal having a larger tensile strength than a tensile strength of metal of the terminal; and the first and second of wire barrels being crimped to the core so that at least first, second and third strands of the core are disposed side by side in a lateral direction intersecting an extending direction of the core and are positioned between the first and second wire barrels, the first wire barrel being crimped so that the first tip is inserted at least partly between the first and second strands in the lateral direction, and the second wire barrel being crimped so that the second is inserted at least partly between the second and third strands in the lateral direction.

2. The wire with terminal of claim 1, wherein an insertion dimension (F) of the first tip of the first wire barrel between the first and second strands and an insertion dimension (F) of the second tip of the second wire barrel between the second and third strands is equal to or larger than a radius (Rw) of each of the strands in a state before the wire barrels are crimped to the core.

3. The wire with terminal of claim 2, wherein the core has no more than seven strands.

4. The wire with terminal of claim 1, wherein the first and second wire barrels are formed respectively with first and second contact portions that contact each other when the first and second wire barrels are crimped to the core.

5. The wire with terminal of claim 1, wherein a radius of curvature Rb of an outer surface of each of the wire barrels crimped to the core satisfies a relationship defined by the following Equation (1) where a thickness T of the wire barrels and a radius Rw of the strands in a state before the wire barrels are crimped to the core (12):

$$Rb>T+Rw \quad (1).$$

6. The wire with terminal of claim 1, wherein:

the core has seven strands, each of the seven strands has a diameter Dw before the wire barrels are crimped to the core; and a width W of the bottom portion in the lateral direction intersecting the extending direction of the core when the first and second wire barrels are crimped to the core satisfies a relationship defined by the following Equation (2):

$$W>4\times Dw \quad (2).$$

7. The wire with terminal of claim 1, wherein:

each of the strands has a radius Rw before the wire barrels are crimped to the core a central part of the bottom portion in the lateral direction bulges out with the wire barrels crimped to the core.

8. The wire with terminal of claim 1, wherein each of the first and second wire barrels has opposite inner and outer surfaces, an area of the inner surface of the first wire barrel adjacent the first tip being laterally inward of and in contact with the first strand, and an area of the inner surface of the second wire barrel adjacent the second tip being laterally inward of and in contact with the third strand.

9. The wire with terminal of claim 1, wherein the second strand is in contact with the first and third strands, the first wire barrel being crimped so that the first tip is farther from the bottom portion than all areas of contact between the first and second strands, and the second wire barrel being crimped so that the second tip is farther from the bottom portion than all areas of contact between the second and third strands.

* * * * *